United States Patent [19]

Papp

[11] Patent Number: 4,883,590

[45] Date of Patent: Nov. 28, 1989

[54] ADJUSTABLE FLOOR DRAIN APPARATUS

[76] Inventor: David J. Papp, 3578A S. 14th St., Milwaukee, Wis. 53221

[21] Appl. No.: 260,043

[22] Filed: Oct. 20, 1988

[51] Int. Cl.[4] ..... E03C 1/26

[52] U.S. Cl. ..... 210/164; 210/460; 210/232; 4/288; 249/183; 249/DIG. 3

[58] Field of Search ..... 210/163, 164, 165, 166, 210/460, 232; 4/288; 249/39, 177, 183, DIG. 2

[56] References Cited

U.S. PATENT DOCUMENTS

| | | | |
|---|---|---|---|
| 1,712,895 | 5/1929 | Metcalf | 52/270 |
| 1,739,067 | 12/1929 | Fleming | 210/164 |
| 1,779,936 | 10/1930 | Hess | 285/263 |
| 1,826,555 | 10/1931 | Lonskey | 210/163 |
| 1,945,707 | 2/1934 | Sharp | 52/221 |
| 2,190,532 | 2/1940 | Lukomski | 210/164 |
| 2,324,545 | 7/1943 | Svirsky | 52/173 R |
| 2,471,301 | 5/1949 | Boosey | 52/220 |
| 2,626,674 | 1/1953 | Boosey | 285/14 |
| 2,695,678 | 11/1954 | Sisk | 210/165 |
| 3,420,552 | 1/1969 | Mork | 285/42 |
| 4,255,909 | 3/1981 | Soderstrom | 52/20 |
| 4,433,860 | 2/1984 | Lindquist | 285/192 |
| 4,614,065 | 9/1986 | Papp | 210/163 |
| 4,620,330 | 11/1986 | Izzi | 138/89 |

FOREIGN PATENT DOCUMENTS

| | | | |
|---|---|---|---|
| 465229 | 5/1937 | France . | |
| 920463 | 3/1963 | United Kingdom | 210/164 |

*Primary Examiner*—W. Gary Jones
*Assistant Examiner*—Matthew O. Savage
*Attorney, Agent, or Firm*—Henderson & Sturm

[57] ABSTRACT

An adjustable floor drain apparatus having an outer cylindrically shaped body with threads on the inside thereof attached to the top of a drain pipe. A cylindrical member is disposed inside of the outer body so that concrete can be poured around the cylindrical member and the concrete will not enter the outer body. An inner cylindrically shaped body having threads on the exterior thereof is provided for mating with the inside threads on the outer body whereby the inner body can be threaded into the outer body and whereby the top thereof can be adjusted up or down to conform to the height of the finished floor. A ring is adapted to engage the top of the inner body and the ring has a partially spherical surface around the lower periphery thereof which contacts the top of the inner body which also has a complementary shaped partial spherical surface thereon for providing a mating slideable joint between the ring and the inner body. The ring is adjustably attached to the inner body. A grate is disposed in a recess on the ring and an optional basket strainer can be installed under the grate.

5 Claims, 5 Drawing Sheets

ADJUSTABLE FLOOR DRAIN APPARATUS

TECHNICAL FIELD

The present invention relates generally to a floor drain structure and more particularly to a floor drain structure which is adjustable vertically to conform to the level of a concrete floor poured therearound and which is also adjustable in pitch so that the top thereof conforms to the pitch of the concrete floor.

BACKGROUND ART

A floor drain in its simplest form is a structure which will funnel liquids from the top of a floor to a drain pipe. Typically these floor drains have a grate attached to the top thereof to allow liquid to flow therethrough but to prevent larger solid objects from entering the floor drain.

A problem associated with the construction of floor drains is the one of adjusting the top thereof to be level with and in alignment with the portion of the floor around it. Because adjusting mechanisms have not been available to accomplish this result without inordinate trouble and expense, often times the floor drain does not conform precisely to and is not in alignment with the top of the floor. Consequently, there is a need for an improved floor drain apparatus which will easily and quickly accomplish this function.

DISCLOSURE OF THE INVENTION

The present invention relates to an adjustable floor drain apparatus having an outer cylindrically shaped body with threads on the inside thereof attached to the top of a drain pipe. A cylindrical member is disposed inside of the outer body so that concrete can be poured around the cylindrical member and the concrete will not enter the outer body. An inner cylindrically shaped body having threads on the exterior thereof is provided for mating with the inside threads on the outer body whereby the inner body can be threaded into the outer body and thereby the top thereof can be adjusted up or down to conform to the height of the finished floor. A ring is adapted to engage the top of the inner body and the ring has a partially spherical surface around the lower periphery thereof which contacts the top of the inner body, which also has a complementary shaped partial spherical surface thereon for providing a mating slideable joint between the ring and the inner body. The ring is adjustably attached to the inner body. A grate is disposed in a recess on the ring and an optional basket strainer can be installed under the grate.

The present invention relates to an improved floor drain apparatus.

Another object of the present invention is to provide an adjustable floor drain apparatus which can be adjusted vertically to conform to the level of a poured concrete floor.

A further object of the present invention is to provide an adjustable floor drain apparatus of the aforementioned type having a grate on the top thereof which can be adjusted in pitch so as to be aligned with the top of a concrete floor whether or not the floor is level.

A still further object of the present invention is to provide a method of installing an adjustable floor drain apparatus which utilizes a removable cylindrical member for use in shielding the adjustable plumbing floor drain from concrete poured around it.

Other objects, advantages, and novel features of the present invention will become apparent from the following detailed description of the invention when considered in conjunction with the accompanying drawings.

BEST MODE FOR CARRYING OUT THE INVENTION

Figure 1:
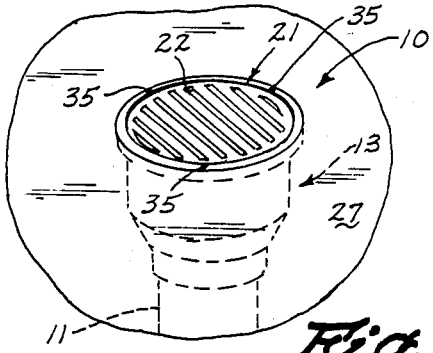
FIG. 1 is a perspective view of an adjustable floor drain constructed in accordance with the present invention shown on a concrete floor, showing in dashed lines a portion thereof below the surface of the concrete floor.
Figure 3:
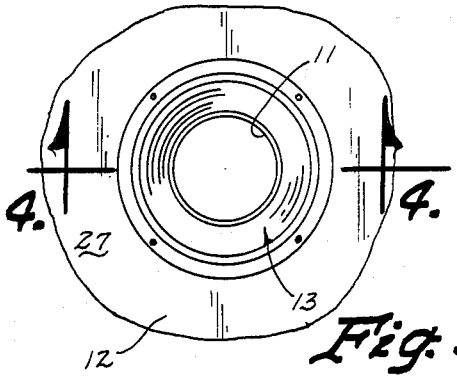
FIG. 3 is a top plan view showing the adjustable floor drain with the inner body grate and ring removed, but being attached to a drain pipe prior to a time that the concrete is poured.

Referring now to the drawings wherein like reference numerals designate identical or corresponding parts throughout the several views, FIG. 1 shows an adjustable floor drain apparatus (10) constructed in accordance with the present invention.

U.S. Pat. No. 4,614,065 to Papp is incorporated herein by reference.

Figure 2:
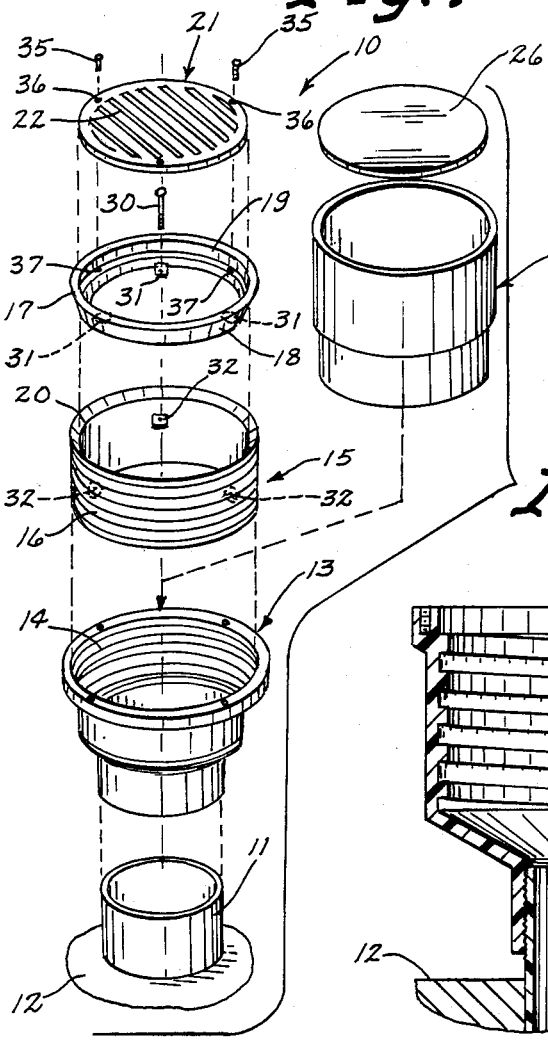
FIG. 2 is an exploded perspective view of the preferred embodiment of the present invention.

Referring to FIG. 2, a floor drain pipe (11) is shown extending up through the earth (12) and which leads to a sewer, septic tank or the like. An outer body (13) has different means on the bottom thereof for different materials used for engaging the top of the drain pipe (11) but is shown with threads as can readily be seen in FIG. 4. The outer body (13) besides having threads on the bottom thereof also has coarser threads (14) on the top interior portion, for threadably receiving an inner cylindrical body (15) having outer threads (16) thereon for mating with the threads (14) of the outer body (13).

A ring (17) having a partially spherical surface (18) on the bottom thereof and a groove (19) on the top thereof fits onto a partially spherical surface (20) on the inner body (15) and a grate (21), having slots (22) therein, is provided for being received in the slot (19) of the ring (17).

Figure 4:
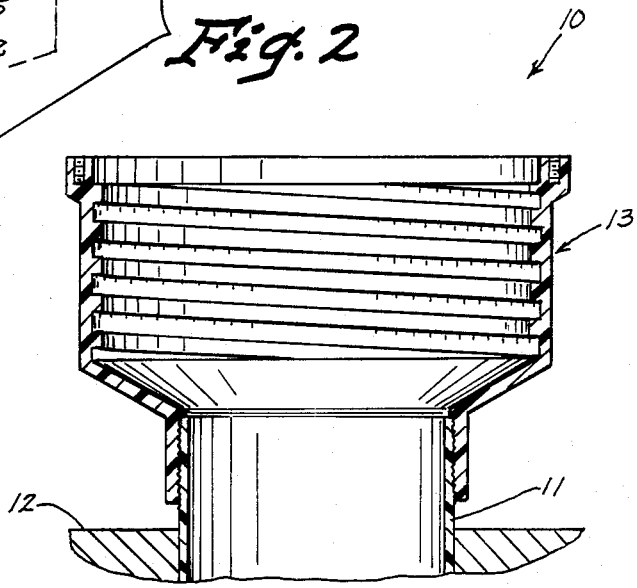
FIG. 4 is a cross-sectional view taken along line 4—4 of FIG. 3.
Figure 5:
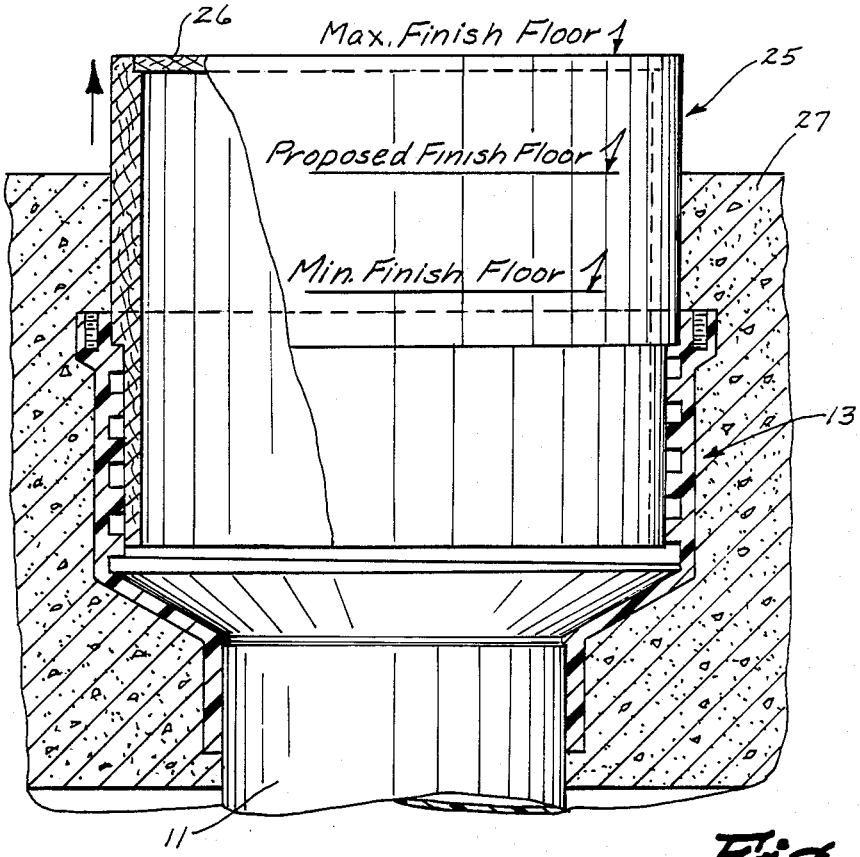
FIG. 5 is a cross-sectional view like FIG. 4, but showing a cylindrical member of wax-coated cardboard fitted inside the outer body of the apparatus shown in FIG. 4 and showing how a concrete floor has been poured therearound without getting any concrete inside of the floor drain apparatus.

To install the drain apparatus (10) shown in FIG. 2, the outer body (13) is first threadably engaged onto the drain pipe (11) in the manner shown in FIG. 4. Then a wax-coated cardboard cylindrical member (25) having a stepped shoulder is inserted into the outer body (13), as is shown in FIG. 5, wherein the reduced diameter bottom portion fits closely against the threads (14) of the outer body (13). The upper and larger diameter cylindrical insert is wider so that the inner body (15) will have access through the concrete floor as will be explained below. With the wax-coated cardboard cylinder (25) in place as is shown in FIG. 5 with the top (26) in place, the concrete floor (27) can be poured therearound to its desired height. Because of the cardboard cylinder (25) and the lid (26) thereof, no concrete will enter the outer body or the area displaced by the cardboard cylinder (25).

Figure 6:
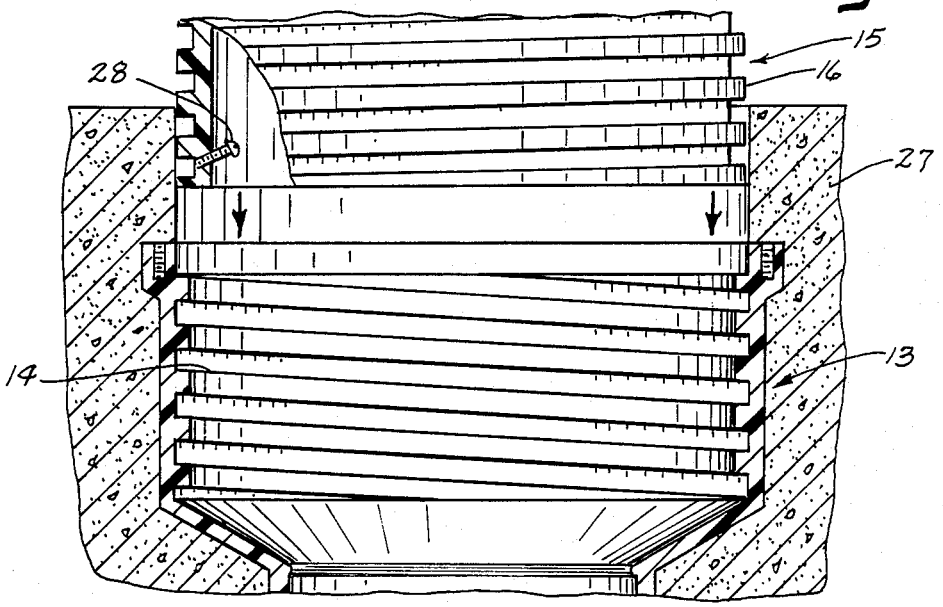
FIG. 6 shows the next step of the installation process from that shown in FIG. 4 wherein the cardboard insert has been removed and an inner body is about to be threaded into the outer body of the floor drain apparatus.
Figure 7:
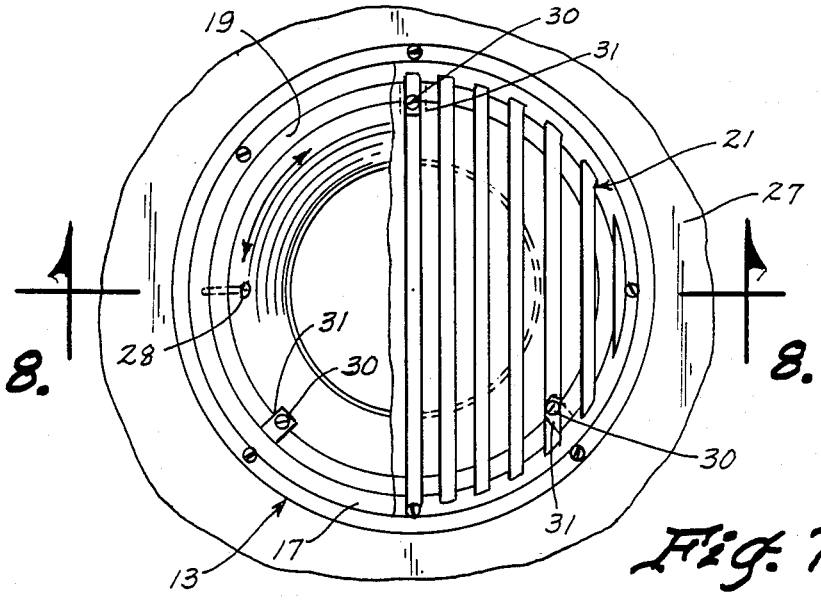
FIG. 7 is a top plan view of the installed floor drain apparatus showing a grate on the top thereof on the right side and a portion of the grate being taken away on the left side in order to show the structure thereunder of the adjustable floor drain apparatus.

After the concrete (27) has cured, the cardboard cylinder (25) and lid (26) are pulled out of the concrete and out of the outer body (13) and the inner body (15), with the set screw (28) in the position shown in FIG. 6, is inserted down into the opening and is then threadably engaged with the outer body (13). The inner body is then rotated down to the position shown in FIG. 8. The ring (17) is placed on top thereof so that the partially spherical surfaces of the ring (17) and the inner body (15) are in a mating relationship. The inner body (15) then can be positioned so that the top of the ring conforms precisely to the top of the concrete (27) by merely further threading the inner body (15) in or out while the set screw (28) is loose. Then the set screw (28) is tightened down against the outer body (13).

Figure 8:
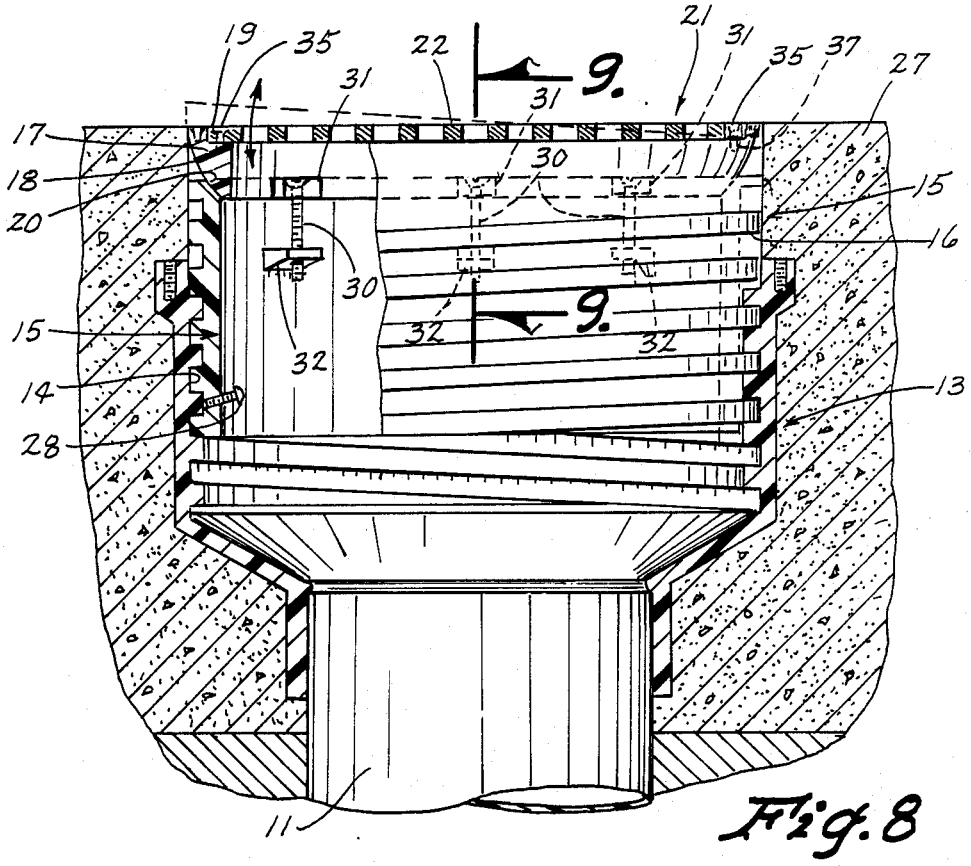
FIG. 8 is a cross-sectional view taken along line 8—8 of FIG. 7.

The pitch of the ring (17) can also be adjusted by using leveling screws (30) which extend through tabs (31) rigidly attached around the lower periphery of the ring (17) and which threadably engage anchors (32) rigidly attached around the inside of the inner body (15). For example as shown in FIG. 8, the leveling screws (30) on the right side have been screwed down further than the leveling screws (30) on the left side in the dashed line position. If the ring (17) is to be perfectly level to conform to a perfectly level floor, then the leveling screws (30) would all be screwed into the anchors (32) at precisely the same distance.

Figure 9:
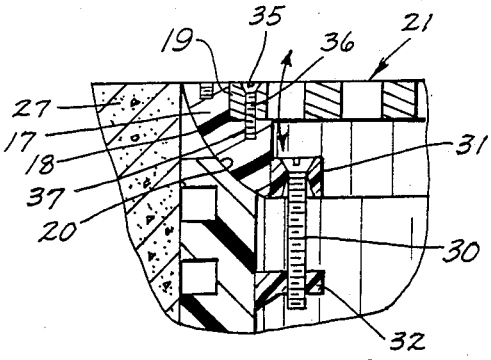
FIG. 9 is an enlarged partial cross-sectional view taken along line 9—9 of FIG. 8 and showing how the upper ring is attached to the inner body in an adjustable fashion.

Referring to FIG. 9, the grate (21) is secured in the groove (19) of ring (17) by threaded fasteners (35) which extend through holes (36) in the grate (21) and into threaded openings (37)in the ring (17).

Figure 10:
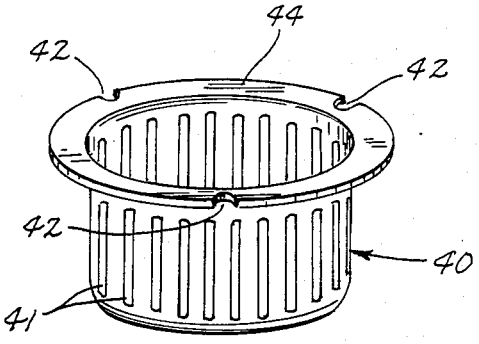
FIG. 10 is an optional basket strainer which can be installed below the grate.
Figure 11:
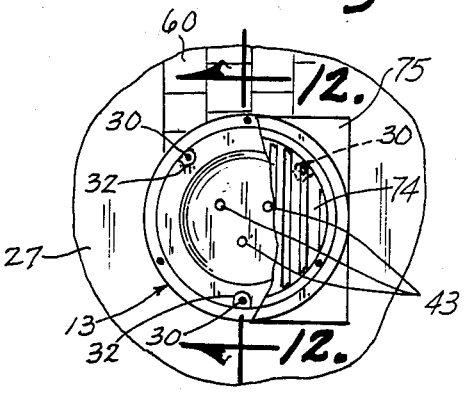
FIG. 11 is a top plan view like FIG. 7 but showing the strainer in use with the grate being shown broken away to show the strainer below it.
Figure 12:
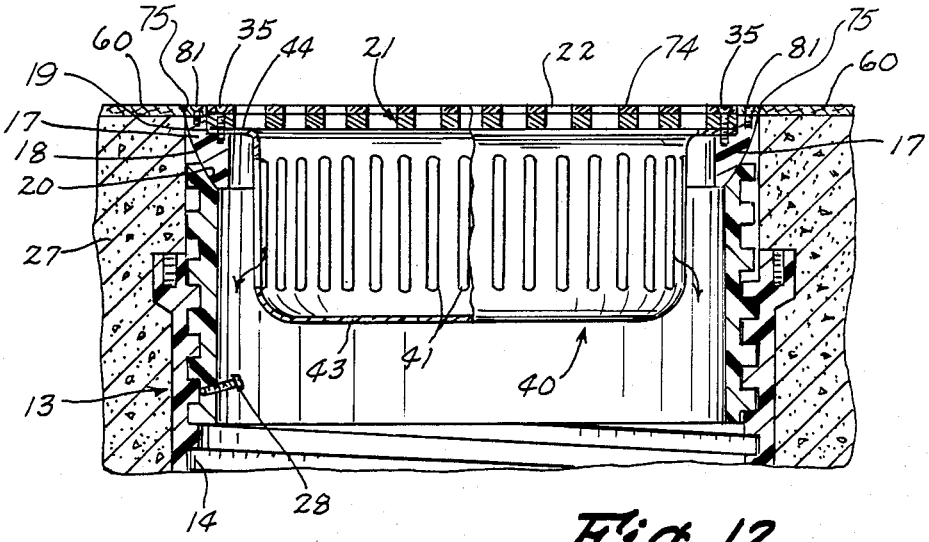
FIG. 12 is a cross-sectional view taken along line 12—12 of FIG. 11.
Figure 13:
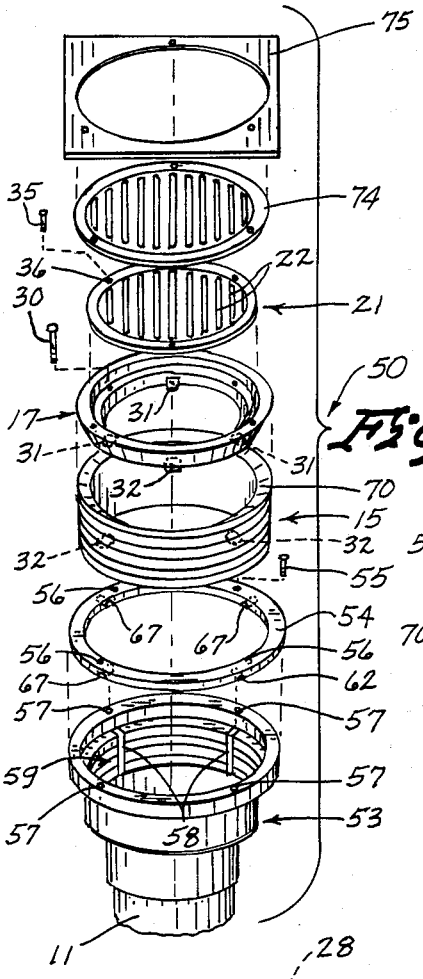
FIG. 13 is an exploded view of an alternate form of the invention.

Referring to FIGS. 10–12, it is noted that an optional strainer (40) having slots (41), notches (42) and holes (43) therein can optionally be used by placing a flange (44) thereof underneath the grate (21) before the grate (21) is attached to the ring (17). The optional basket strainer (40) will collect solid particles passing through the wider slots (22) of the grate which will not pass through the narrower slots (41) of the basket strainer (40). When the basket strainer (40) becomes full of solids, it can be removed by removing the grate (21) and emptied. It can then be reinstalled. Tile (60) on concrete floor (27) is optional, but if used, chrome tile ring (75), chrome grate cover (74), and tile ring screws (81) are necessary.

Figure 15:
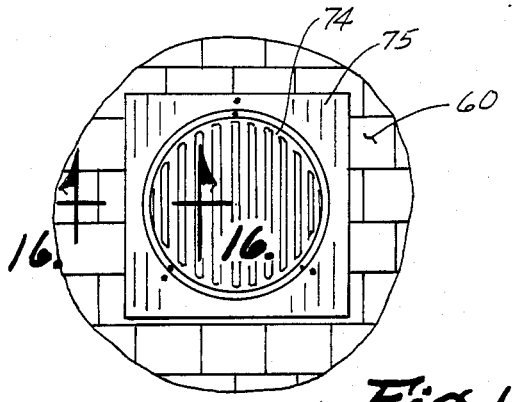
FIG. 15 is a top plan view of the FIG. 13 embodiment of the invention shown installed in a floor.
Figure 16:
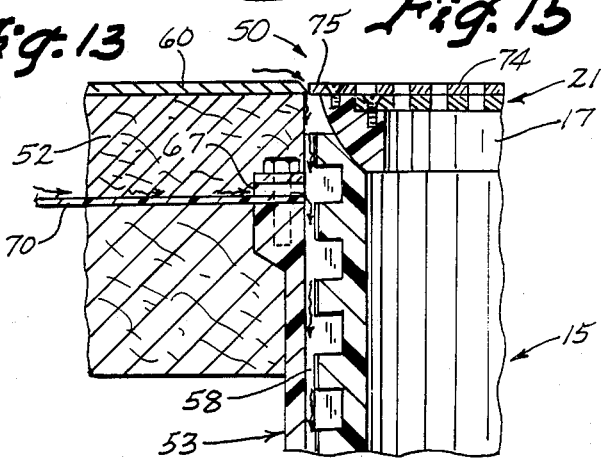
FIG. 16 is a enlarged cross-sectional view taken along line 16—16 of FIG. 15.
Figure 14:
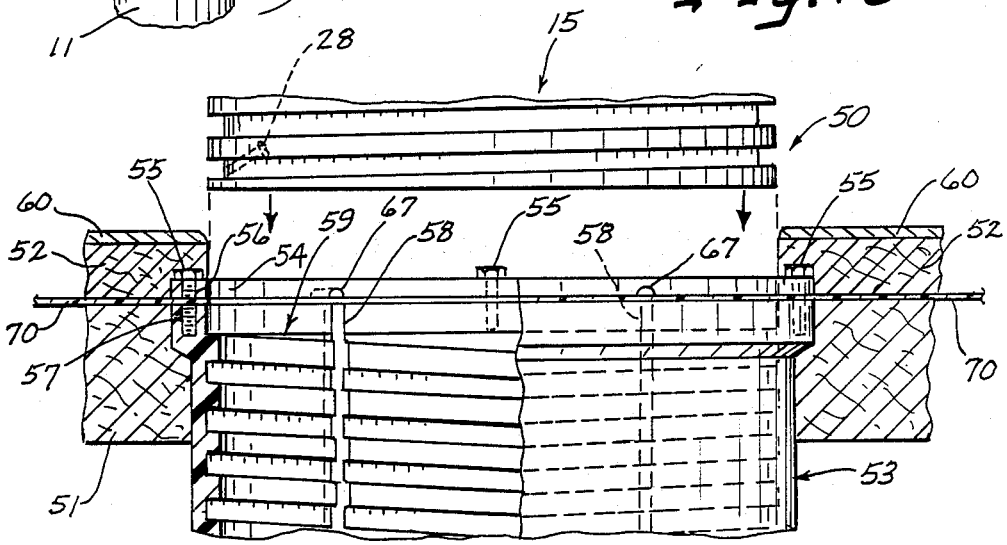
FIG. 14 is an enlarged partial cross-sectional view of the installed FIG. 13 embodiment.

FIGS. 13–16 show an alternate form of the invention referred to as (50) for above ground installation into a wooden floor (51) or the like. A concrete or tile mud mix (52) extends on top of the floor below safing material (70) and an outer body (53), very similar to the outer body (13) referred to above, is attached onto a drain pipe (11). The outer body (53) has a ring (54) fastened therethrough by threaded fasteners (55) which extend through openings (56) in the ring and into threaded openings (57) in the top of the outer body (53). The installed form of the embodiment (50) is shown in FIG. 16 wherein drain holes (67) extending under and around the ring (54) are lined up with slots (58) which extend down through the threads (59) of the outer body (53). Then the inner body (15) is threaded down into the outer body (53), as before, and is adjusted so that when the ring (17) and grate (21) are placed on top thereof they will be flat on a level with the membrane (52) or with the floor covering tile (60), as desired. A square tile ring (75) as shown in FIG. 15 is optional.

Accordingly it will be appreciated that the preferred embodiment shown does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. An adjustable floor drain apparatus comprising:

an outer cylindrically shaped body having an interior portion having threads disposed on the inside thereof, and having a predetermined inner diameter;

means for attaching said outer body to a top portion of a drain pipe having an outer diameter smaller than said predetermined inner diameter of outer body;

means for forming a seal between the top of said pipe and the bottom of said outer body;

a stepped shoulder removable cylindrical member having an enlarged upper outer diameter and a reduced dimension lower outer diameter wherein the lower outer diameter is smaller than the diameter of said inner portion of said outer body whereby at least the lower outer diameter of said cylindrical member is slideable relative to the inside of said outer body so that concrete poured around said cylindrical member will not come into contact with a substantial portion of the threads on the outer body and whereby said cylindrical member is removable from said outer body after the concrete has cured;

an inner cylindrically shaped body having thread means on the exterior thereof for mating with the inside thread means on said outer body whereby said inner body is threadable into said outer body in a space vacated by said cylindrical member;

ring means adapted to engage the top of said inner body, said ring means having a partially spherical surface around the lower outer periphery thereof and the top of said inner body having a complementary shaped partial spherical surface thereon for providing a mating slidable joint between said ring means and said inner body;

means for adjustably attaching said ring means to said inner body;

a grate having openings therethrough; and recess means for receivably holding said grate on top of said ring means.

2. The apparatus of claim 1 wherein said cylindrical member is made of wax-coated cardboard.

3. The apparatus of claim 1 wherein said attaching means includes bolts threadably engageable with threaded opening structures attached to said inner body, said ring means having openings therein through which said bolts are received.

4. The apparatus of claim 1 including set screw means extending through said inner body and in engagement with said outer body.

5. The apparatus of claim 1 including a perforated cup-shaped strainer means disposed beneath said grate and at least partially inside of said inner body for collecting solid particles which pass through said grate.

* * * * *